US006910223B2

(12) United States Patent
Egnew

(10) Patent No.: US 6,910,223 B2
(45) Date of Patent: Jun. 28, 2005

(54) CAMOUFLAGE COVERING SYSTEM

(75) Inventor: James C. Egnew, Stearns, KY (US)

(73) Assignee: Shelter-Pro, LLC, Stearns, KY (US)

( * ) Notice: Subject to any disclaimer, the term of this patent is extended or adjusted under 35 U.S.C. 154(b) by 0 days.

(21) Appl. No.: 10/669,113

(22) Filed: Sep. 23, 2003

(65) Prior Publication Data

US 2004/0055068 A1 Mar. 25, 2004

Related U.S. Application Data

(60) Continuation-in-part of application No. 10/330,917, filed on Dec. 26, 2002, now Pat. No. 6,675,394, which is a division of application No. 09/982,184, filed on Oct. 17, 2001, now Pat. No. 6,499,141.

(60) Provisional application No. 60/313,616, filed on Aug. 20, 2001.

(51) Int. Cl.[7] ..... A41D 13/00

(52) U.S. Cl. ..... 2/69; 2/900

(58) Field of Search ..... 2/69, 93, 94, 85, 2/108, 115, 79, 227, 69.5, 900; 428/15, 17, 919

(56) References Cited

U.S. PATENT DOCUMENTS

| | | | | | |
|---|---|---|---|---|---|
| 5,445,863 | A | * | 8/1995 | Slagle et al. | 428/156 |
| 5,476,561 | A | * | 12/1995 | Bylund et al. | 156/85 |
| 5,675,838 | A | * | 10/1997 | Hollinger | 2/69 |
| 5,695,835 | A | * | 12/1997 | Weber et al. | 428/17 |
| D446,908 | S | | 8/2001 | Egnew | |
| 6,499,141 | B1 | * | 12/2002 | Egnew | 2/69 |
| 6,675,394 | B2 | | 1/2004 | Egnew | |
| D488,828 | S | | 4/2004 | Egnew | |
| 2003/0200599 | A1 | | 10/2003 | Shultz et al. | |
| 2003/0217406 | A1 | | 11/2003 | Shultz et al. | |

* cited by examiner

*Primary Examiner*—Tejash Patel
(74) *Attorney, Agent, or Firm*—J.M. Robertson Intellectual Prop. LLC

(57) ABSTRACT

A camouflage outer wear garment system including garments incorporating selected patterns of leaf simulating camouflage strips. At least a portion of the camouflage strips include a multiplicity of texture imparting pleats projecting in transverse angled relation to the length direction of the strips. The camouflage strips may be arranged across portions of a jacket, trousers and/or hood for use alone or in combination with other garments.

25 Claims, 6 Drawing Sheets

FIG. —1—

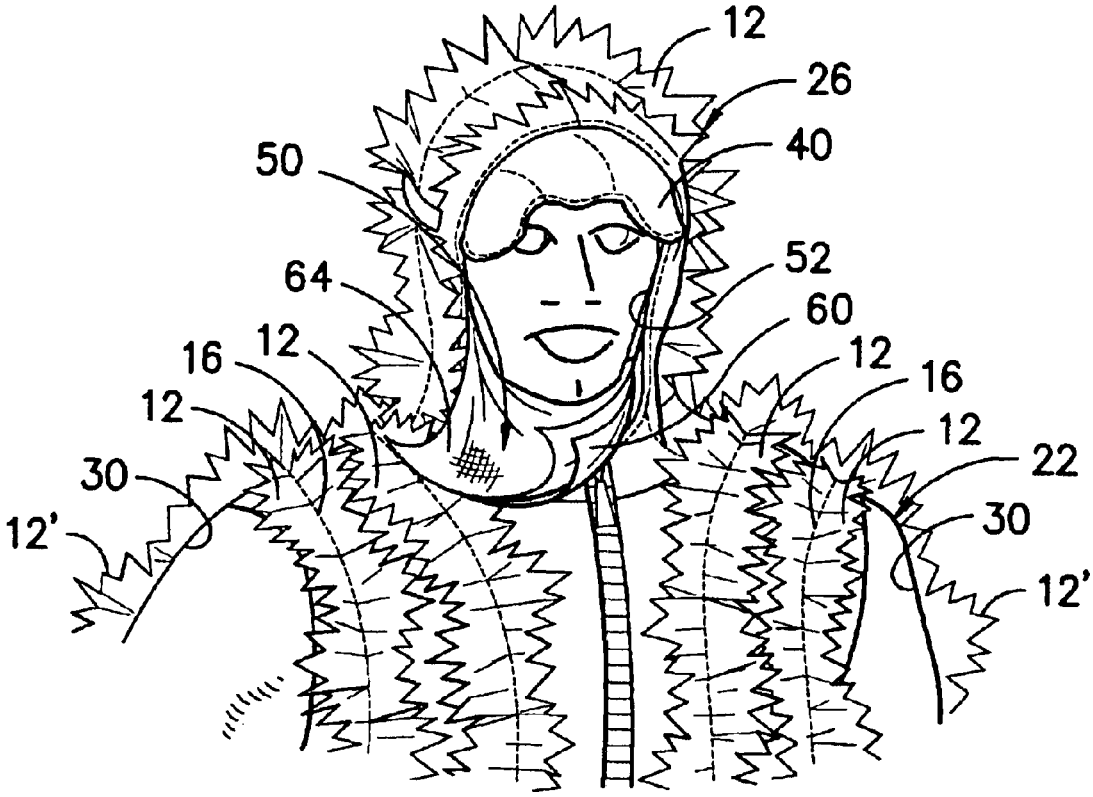
FIG. –5C–

CAMOUFLAGE COVERING SYSTEM

CROSS-REFERENCE TO RELATED APPLICATION

This application is a continuation-in-part of commonly owned co-pending application Ser. No. 10/330,917 filed Dec. 26, 2002 which is a division of application Ser. No. 09/982,184 filed Oct. 17, 2001 (now U.S. Pat. No. 6,499,141) which claims benefit and priority from provisional application No. 60/313,616 filed Aug. 20, 2001. The contents of all referenced applications and patents are hereby incorporated by reference herein in their entirety.

TECHNICAL FIELD

The present invention is directed to camouflaged clothing generally to be used by sportspersons, hunters, photographers, and others observing wildlife in their natural environment. More particularly, the invention provides a camouflage clothing system in which strips of material simulating outwardly protruding leaf structures are disposed selectively across the clothing so as to disturb the profile of the wearer. The profile disturbing leaf strips are formed from material seamed to the exterior of the clothing. At least a portion of the leaf strips include an arrangement of pleats transverse to the length direction of the strips to provide enhanced profile disruption.

BACKGROUND OF THE INVENTION

The use of manufactured camouflaged material is an extension of the use of natural materials to cause a structure or individual to blend into its natural background and escape visual detection. The development of camouflage materials has lead to the manufacture of clothing with the same purpose as the use of such natural materials. The use of colored camouflage material imprinted with a pattern corresponding to the background terrain occupied by a user is well known. While camouflage materials which rely strictly on patterning may provide a degree of concealment, a wearer may nonetheless still be detected by his or her body profile standing out in relief relative to the background terrain. In order to address this deficiency, it has been recognized that so-called three-dimensional fabrics including a substrate layer and integrated outwardly protruding leaf elements may be utilized to disrupt the wearer's profile. By way of example only, U.S. Pat. No. 4,931,320 (incorporated by reference) discloses three-dimensional camouflage fabric manufactured from a net base to which is affixed along spaced lines an overlying sheet of camouflage material. The sheet of camouflage material is cut along opposite sides of the spaced lines in shapes and patterns to simulate natural vegetation, terrain, and shadows. U.S. Pat. No. 5,261,978 (incorporated herein by reference) discloses a method and apparatus for raising lobes of camouflage material away from the fabric plane by heat treating. While such practices may provide structures with good camouflage protection, such manufacturing techniques are relatively complex and may result in substantial quantities of wasted material in the cut-out zones of the overall overlying sheet structure.

SUMMARY OF THE INVENTION

The present invention provides advantages and alternatives over the prior art by providing a camouflage system incorporating an arrangement of profile disturbing strip elements disposed selectively in attached relation across a garment surface. The strip elements may be of either single edge or double edge construction. At least a portion of the strip elements may include integral pleats randomly or irregularly disposed in transverse relation to the length direction of the strip elements so as to augment camouflage performance.

BRIEF DESCRIPTION OF THE DRAWINGS

The present invention will now be described by way of example only, with reference to the accompanying drawings which constitute a part of the specification herein and in which:

FIG. 5C is a view similar to FIG. 5A, wherein all layers of the face veil structure are pulled down beneath the chin of the wearer to open the face opening entirely.

While the invention has been illustrated and will hereinafter be described in connection with certain exemplary and potentially preferred embodiments and practices, it is to be understood that in no event is the invention to be limited to such illustrated and described embodiments and practices. On the contrary, it is intended that the invention shall extend to all alternatives and modifications as may embrace the principles of this invention within the fill spirit and scope thereof.

DESCRIPTION OF THE PREFERRED EMBODIMENT

Figure 1:
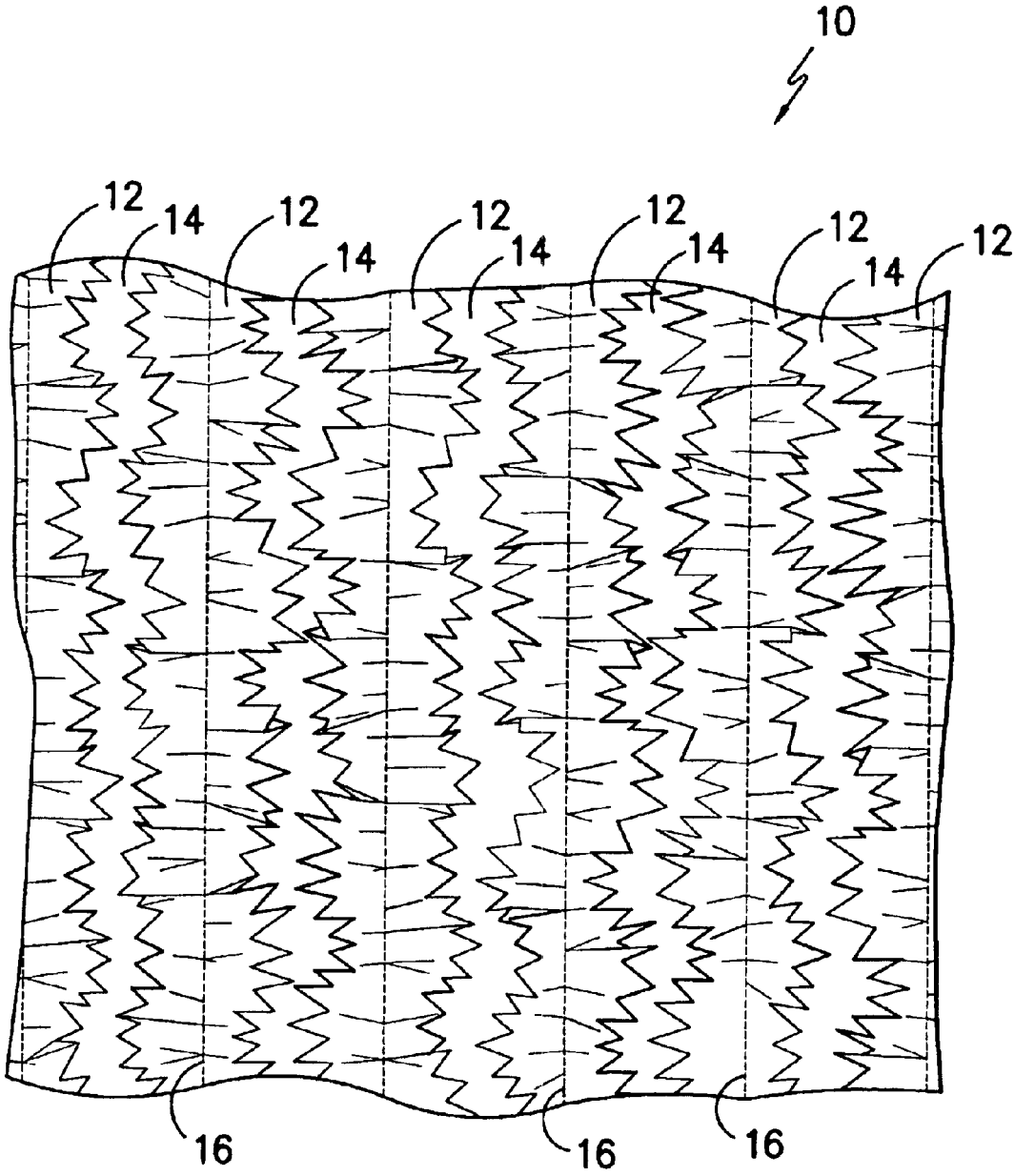
FIG. 1 illustrates an exemplary fabric panel for the manufacture of camouflage clothing which includes an arrangement of randomly pleated camouflage strip elements affixed to a separately formed independent base fabric.

Reference will now be made to the several figures wherein to the extent possible like reference numerals are used throughout the various views to designate the same feature, material, or relationship. As previously indicated, the camouflage system of the present invention utilizes the selective attachment of the leaf-simulating camouflage strips across panels of fabric forming one or more clothing articles. By way of example only, FIG. 1 illustrates a panel 10 incorporating an arrangement of leaf-simulating camouflage strips 12 seamed in place across a base fabric 14 by seams 16 such as sewn seams, adhesive seams, welded seams, and the like. While the seams 16 and attached strips 12 are illustrated in substantially parallel relation to one another, it is to be understood that such an arrangement is exemplary only and that the strips 12 may be disposed at various angles relative to one another across the panel 10.

According to one contemplated construction, the strips 12 and the base fabric 14 are formed from the same material such as a camouflage printed, lightweight woven pongee cloth or lightweight knitted mesh of nylon, polyester, or the like. Such lightweight materials provide excellent ventilation while nonetheless concealing the wearer and providing protection against intrusion by biting insects. Of course, it is also contemplated that different materials may be used in the strips 12 and the base fabric 14. Moreover, it is also contemplated that different colors or patterns may be used across different portions of the panel 10. The ability to apply the individual strips 12 as discreet units across the base fabric 14 thus affords a substantial degree of freedom in developing desired patterning combinations.

Figure 2:
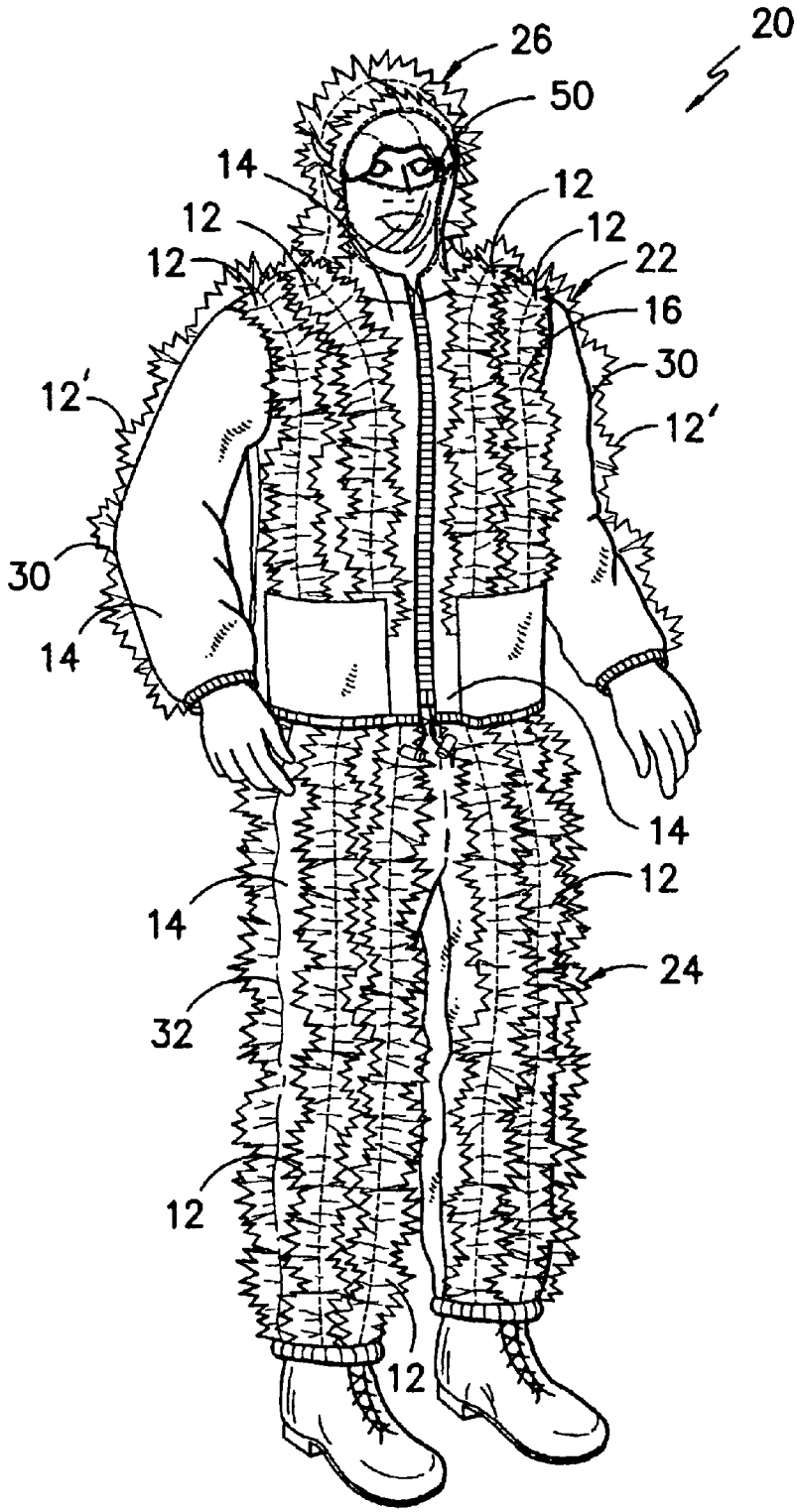
FIG. 2 is a front perspective view of an exemplary set of camouflage clothing.

As illustrated in FIG. 2, it is contemplated that panels 10 incorporating a desired arrangement of leaf-simulating camouflage strips 12 may be utilized in the formation of a camouflage suit 20 in which the camouflage strips 12, 12' are used to disrupt the silhouette of the wearer.

In the illustrated embodiment, the suit 20 includes a jacket 22, trousers 24, and a hood 26. As shown, the camouflage strips 12 are seamed across the surface of the garment to disrupt or distort the natural silhouette of the wearer, thereby enhancing the effectiveness of the camouflage coloration and/or pattern. The attachment of the strips is preferably effected by the seams 16 which extend along the length of the individual strips such that irregular edges of the strip project away from both sides of the seams. Strips 12' having a single protruding irregular edge may also be attached along and/or inserted within the garment formation seams such as a sleeve seam 30 running along the outboard edge of the jacket sleeves and/or an outboard trouser seam 32 running between front and rear panels of the trousers. As illustrated, the utilization of the garment seams allows a strip edge to project outwardly away from the garment seam thus substantially aiding in the disruption of the wearer's silhouette.

As illustrated in the various views, at least a portion of the leaf-simulating camouflage strips 12 are pleated or ruffled along their length such that a multiplicity of pleats extends at a transverse angle relative to the seams holding the strips 12 in place. According to the potentially preferred practice, the arrangement of pleats is substantially random along the length of the strips so as to provide a highly irregular appearance. The pleated arrangement may be maintained by the seams 16 such that an arrangement of overlaps and underlaps are present within the body of the strips 12 in the assembled condition. These pleats are believed to substantially enhance the camouflage character of the garment.

Figure 3A:
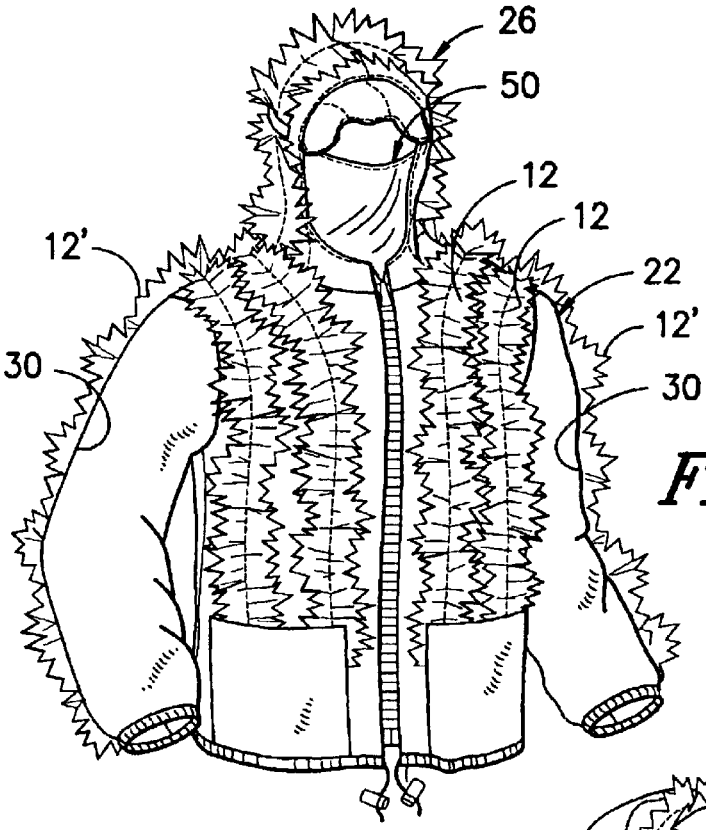
FIGS. 3A and 3B are respectively, a front and rear view of a camouflage jacket and hood combination including an arrangement of profile-disturbing randomly pleated camouflage strips.
Figure 3B:
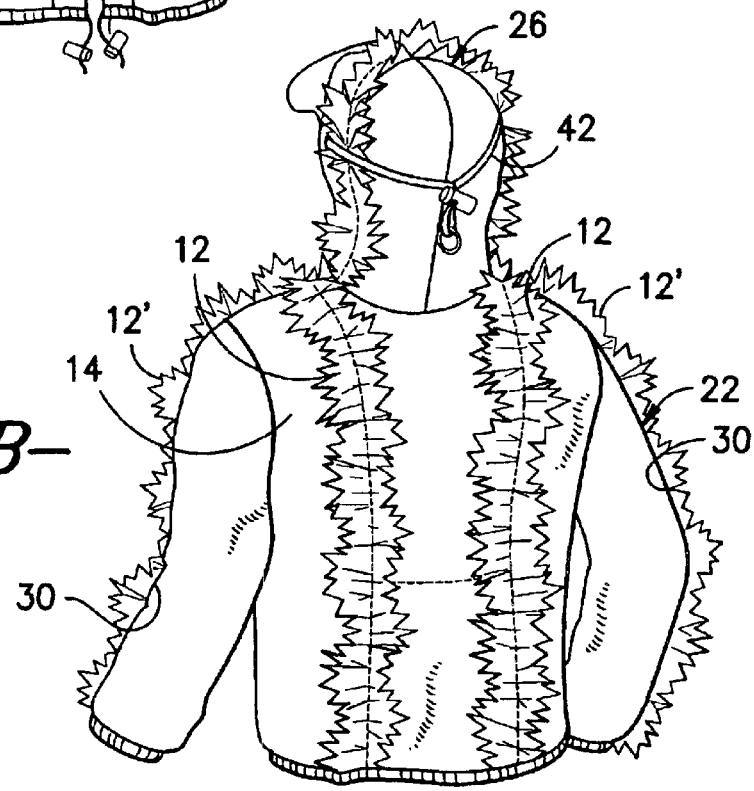

Turning now to FIGS. 3A and 3B an exemplary jacket and hood combination is illustrated. Of course, it is to be understood that the jacket 22 and hood 26 need not be formed as a single component. Moreover, it is contemplated that a user may utilize the jacket without the hood or the hood without the jacket if desired. According to the illustrated exemplary arrangement, the chest panel of the jacket 22 includes a multiplicity of double edge pleated camouflage strips 12 extending away from the shoulder line so as to define an irregular surface across the front of the jacket 22. Likewise, an arrangement of double edge pleated camouflage strips 12 extends away from the shoulder line and across the back panel of the jacket 22 so as to provide at least a degree of coverage across the back panel. However, it is also contemplated that the chest panel and/or the back panel may be devoid of camouflage strips 12 if desired. In the illustrated arrangement, a single edge pleated camouflage strip 12' is held within the sleeve seam 30 at either sleeve such that a simulated leaf edge projects away from the sleeve seam 30. A double edge pleated camouflage strip 12 also extends over the top of the hood 26 so as to further obscure the wearer's profile. Of course, it is to be understood that the double edge strips 12 and single edge strips 12' may be interchanged with one another at any location as may be desired.

Figure 4:
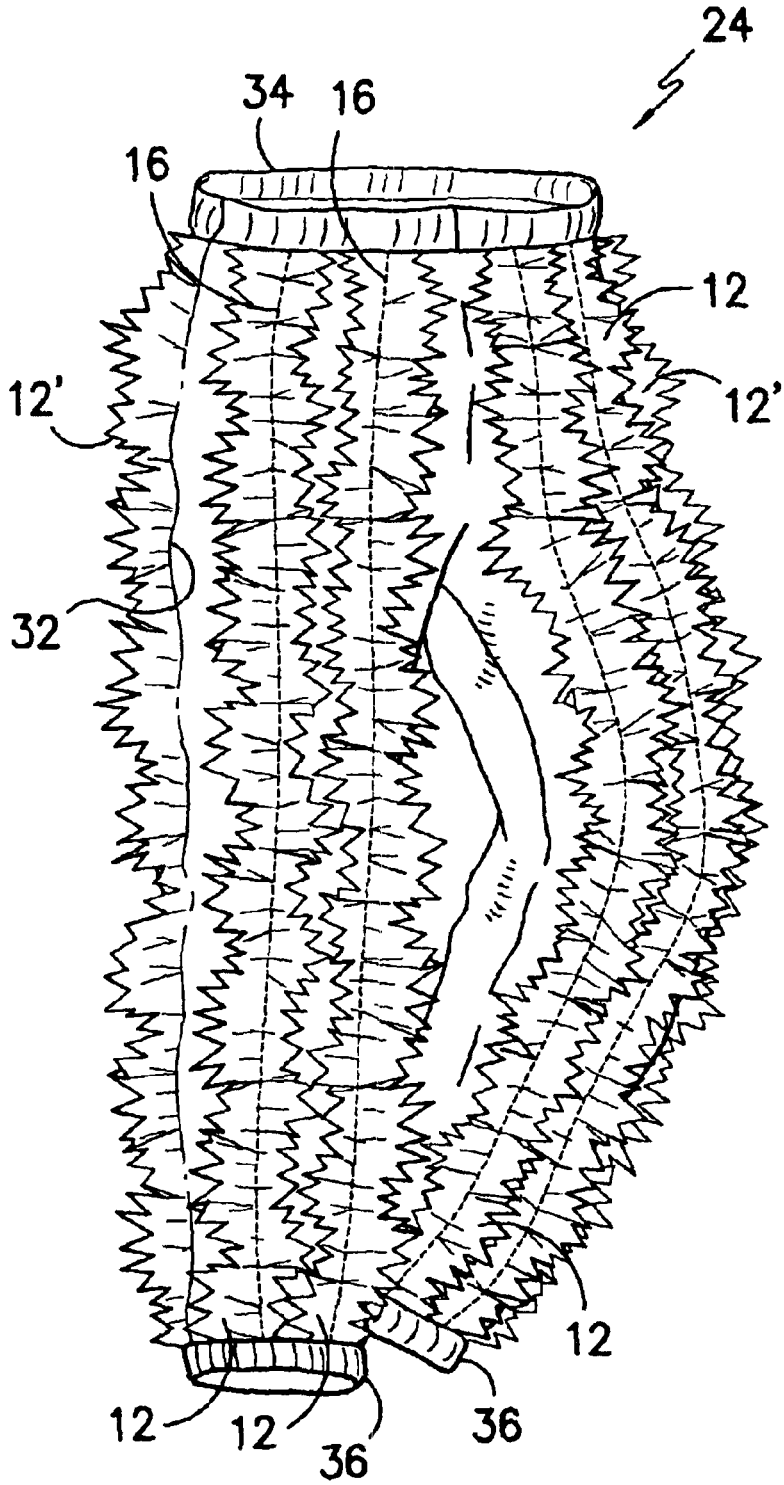
FIG. 4 is a front perspective view of trousers incorporating an arrangement of profile disturbing randomly pleated camouflage strips.

FIG. 4 illustrates basic details of one embodiment of camouflage trousers. As illustrated in this embodiment an arrangement of double edge camouflage strips extend at least partially across the front of the trousers with single edge camouflage strips 12' projecting away from the outboard trouser seams 32. The rear portion of the trousers is preferably devoid of applied camouflage strips although such strips may be used in this area if desired. An elastic waistband 34 may be used to hold the trousers 24 in a comfortable position. However, it is likewise contemplated that a belt or drawstring may be utilized to replace or augment the waistband 34 if desired. Elastic cuffs 36 may be used to hold each leg securely in contact with the ankle of the wearer. Alternatively, cuffs may be held by drawstrings or tapered and closed with attachment mechanisms such as zippers, snaps, hook and loop fasteners, or the like.

Referring simultaneously to FIGS. 3A, 3B, 5A, 5B, and 5C it may be seen that the hood 26 is provided with one double edge pleated camouflage strip which extends from shoulder to shoulder across a top of a wearer's head. Of course, additional single or double edge strips may be used if desired. As illustrated, the hood 26 is preferably provided with a visor 40. The visor 40 is preferably constructed of a panel of the lightweight base fabric 14 as is used in other portions of the suit 20. However, it is also contemplated that the visor 40 may incorporate additional stiffening structures such as a layer of non-woven felt or the like as will be well known in the art if further stiffening is desired. As shown, the hood 26 is also preferably adjustable by a drawstring 42 (FIG. 3B) extending rearwardly from positions adjacent the visor.

The hood 26 may be attached around a neck opening in the jacket 22 such that the hood 26 and the jacket 22 are integral with one another in substantially permanent fixed relation. It is also contemplated that the hood 26 and the jacket 22 may be adjoined by disengagable attachment elements including, by way of example only, zippers, snaps, buttons, and hood and loop fabric fasteners. Of course, it is also contemplated that the hood 26 may be physically separate from the jacket 22. In such an arrangement, the neck portion of the hood 26 may drape partially over a user's shoulder or may be tucked under the neck opening of the jacket 22.

Figure 5A:
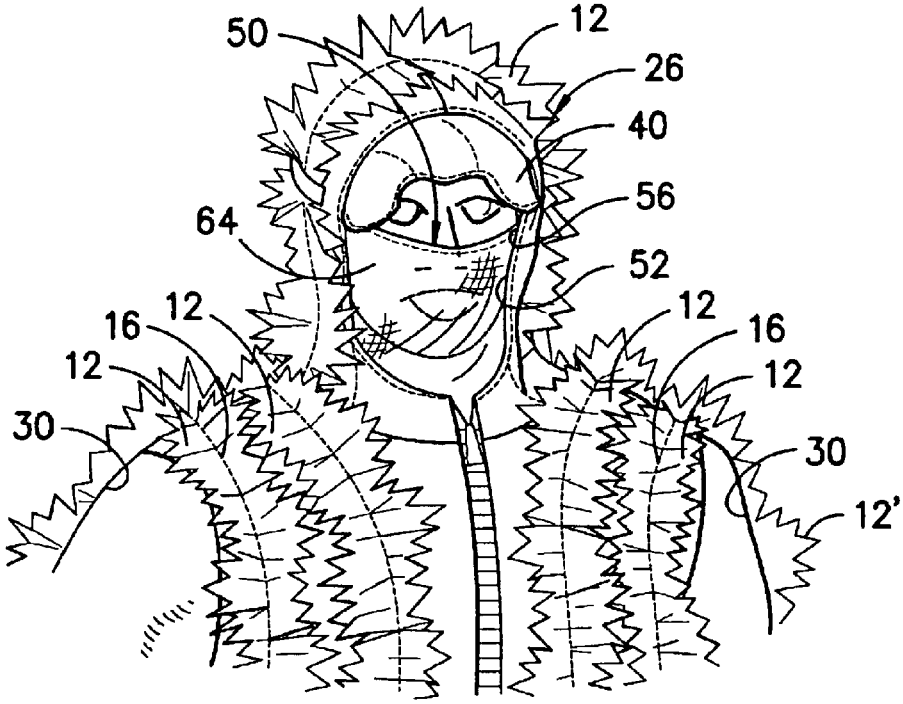
FIG. 5A is a detailed view of a camouflage hood including a multi-layer face veil structure including a top mesh portion and a bottom camouflage fabric portion disposed in layered relation across the lower portion of a user's face.
Figure 5B:
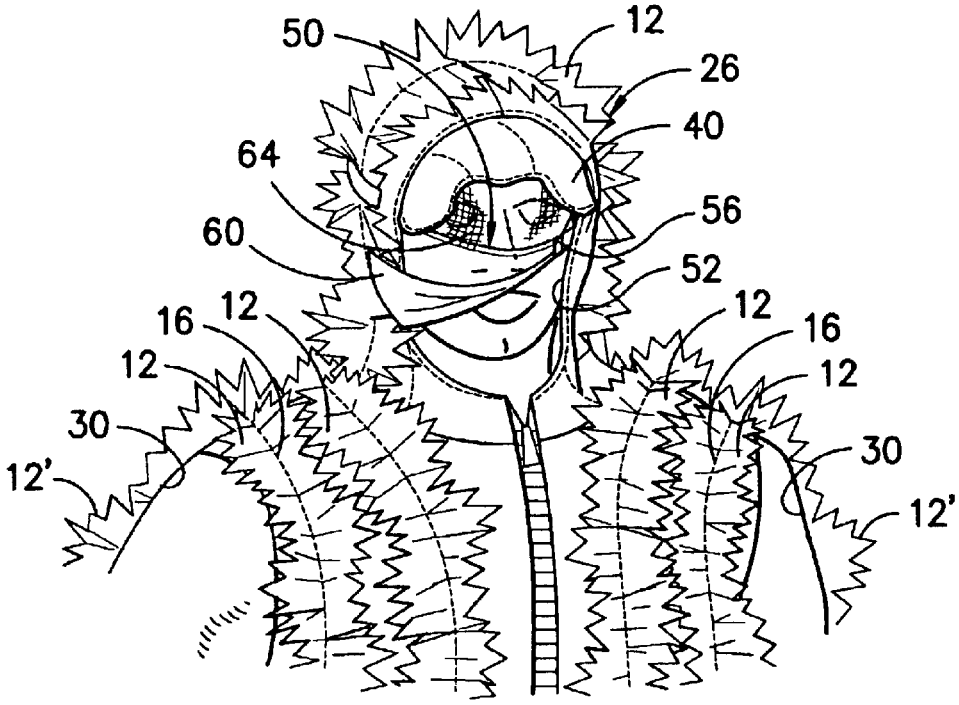
FIG. 5B is a view similar to FIG. 5A wherein a top mesh portion of the face veil structure is raised in covering relation to an upper portion of a user's face and a bottom camouflage fabric portion hangs down across a lower portion of the user's face with the bottom portion illustrated pulled back from a lower corner to illustrate manipulation capability.

As previously indicated, the hood 26 preferably includes a face veil structure 50 including a layer affixed along one side of the hood face opening by a fixed attachment such as sewn seam between the veil structure 50 and one side of the face opening. As illustrated, the veil structure 50 preferably is also operatively connected to the opposing side of the face opening at an opposing lateral edge 52 running along the face opening. By way of example only, it is contemplated that the operative connection between the veil structure 50 and the edge 52 of the face opening may be established by a relatively short, narrow highly extensible elastomeric fabric strip 56 which is best illustrated in FIG. 5B. The elastomeric fabric strip preferably extends between the veil structure and an interior location adjacent the edge 52 so as to normally hold the veil structure across the face opening in edge-to-edge uninterrupted coverage while nonetheless permitting the user to raise or lower the various layers of the veil structure as illustrated in FIGS. 5B and 5C. In particular, as illustrated in FIG. 5B if desired a lower portion 60 of the veil structure may be conveniently raised as desired such as to permit the manipulation of a game call or the like. As illustrated in FIG. 5C, the use of the elastomeric fabric strip also permits the user to pull the entire veil structure 50 down below his or her chin if face coverage is not desired without the necessity of removing the hood 26. In addition, the use of the elastomeric fabric strip 56 to effect connection between the veil structure 50 and an edge of the face opening permits the user to pull the hood 26 back over his or her head during which the face opening may have to expand. Thus, the veil structure 50 provides concealment without unduly constricting the face opening.

According to one potentially preferred construction, the veil structure 50 includes a lower portion 60 adapted to hang in covering relation across the lower segment of the face opening. The veil structure 50 also preferably includes an upper portion 64 attached in hinging relation along the upper edge of the lower portion 60 and adapted to be folded up and over an upper segment of the face opening during use. Thus, the lower portion 60 and the upper portion 64 serve to cooperatively cover the entire face opening within the hood 26.

According to one potentially preferred practice the material forming the lower portion 60 may be a lightweight colored or printed camouflage fabric and will most preferably be of the same construction and pattern as the material forming the camouflage strips 12, or 12' and/or the base fabric 14. The upper portion 64 which covers the eyes of the user is preferably formed from a dark unprinted mesh material so as to reduce glare and improve visibility. One such material which may be used in the upper portion 64 is a relatively open mesh knit fabric of black, dark green, or other suitable coloration. In such a construction there is preferably a substantial interstitial void area between the yarns so as to promote visibility while nonetheless providing a level of light filtration to reduce glare. However, the individual interstitial openings should nonetheless be small enough to prevent undesired insect incursion.

While the invention has been illustrated and described in relation to certain exemplary embodiments, constructions, and procedures, it is to be understood that such embodiments, constructions, and procedures are illustrative only and that the present invention is in no event to be limited thereto. To the contrary, it is contemplated that modifications and variations embodying the principles of this invention will no doubt occur to those of skill in the art and it is thus intended that the present invention shall extend to all such modifications and variations as may incorporate the broad principles of the invention within the full spirit and scope thereof.

That which is claimed is:

1. A camouflage outer wear system comprising at least one garment for covering a portion of a user's body, wherein at least a portion of the garment comprises a single layer base fabric of camouflage printed textile material with at least one elongate leaf-simulating strip of camouflage printed material having a length dimension and a width dimension attached to the garment in partial covering relation to the base fabric so as to impart an irregular surface across the garment, and wherein the strip of camouflage printed material comprises a plurality of texture imparting surface pleats extending in transverse angled relation to the length dimension of the strip and wherein the base fabric of camouflage printed material and the strip of camouflage printed material consist essentially of knitted mesh fabric.

2. The invention as recited in claim 1, wherein said garment is a jacket.

3. The invention as recited in claim 1, wherein said garment is a hood.

4. The invention as recited in claim 3, wherein said hood is integrally attached to a jacket.

5. The invention as recited in claim 1, wherein said garment is a pair of trousers.

6. The invention as recited in claim 1, wherein the elongate leaf-simulating strip comprises a pair of opposing irregular edges and wherein the elongate leaf-simulating strip is attached to the garment by an attachment seam extending along the length dimension of the strip between the irregular edges such that the irregular edges project away from both sides of the attachment seam.

7. The invention as recited in claim 1, wherein the elongate leaf-simulating strip comprises an irregular edge and wherein the elongate leaf-simulating strip is attached to the garment by a garment assembly seam adjoining panels of the base fabric such that the irregular edge projects outwardly along the garment assembly seam.

8. The invention as recited in claim 7, wherein the garment is a jacket and wherein elongate leaf-simulating strips comprising a plurality of texture imparting surface pleats extending in transverse angled relation to the length dimension of said strips are disposed within garment assembly seams extending along shoulder portions of the jacket such that an irregular edge projects away from the shoulder line of the jacket to disrupt the profile of the shoulder line.

9. The invention as recited in claim 7, wherein the garment is a jacket and wherein elongate leaf-simulating strips comprising a plurality of texture imparting surface pleats extending in transverse angled relation to the length dimension of the strip are disposed within garment assembly seams extending along exterior sleeve portions of the jacket such that an irregular edge projects away from the exterior sleeve portions to disrupt the profile of the sleeves.

10. The invention as recited in claim 7, wherein the garment is a pair of trousers and wherein elongate leaf-simulating strips comprising a plurality of texture imparting surface pleats extending in transverse angled relation to the length dimension of the strip are disposed within out seams disposed between panels of material extending along the exterior of the user's legs such that an irregular edge projects away from the sides of the trousers to disrupt the profile of the trousers.

11. A camouflage outer wear system comprising a jacket, for covering a chest and arm portion of a user's body, wherein at least a portion of the jacket comprises a single layer base fabric of camouflage printed textile material with a plurality of elongate leaf-simulating strips of camouflage printed material having a length dimension and a width dimension attached to the jacket in partial covering relation to the base fabric so as to impart an irregular surface across the jacket, and wherein at least a portion of the strips of camouflage printed material comprise a plurality of texture imparting surface pleats extending in transverse angled relation to the length dimension of the strips and wherein the base fabric of camouflage printed material and the strips of camouflage printed material consist essentially of knitted mesh fabric.

12. The invention as recited in claim 11, wherein a plurality of elongate leaf-simulating strips extend in a pattern across a chest covering portion of the jacket, and wherein at least a portion of the strips extending across the chest covering portion are double edged strips comprising a pair of opposing irregular edges and a plurality of texture imparting surface pleats extending in transverse angled relation to the length dimension of the strips and wherein the double edged strips are attached to the garment by an attachment seam extending along the length dimension of the strips between the irregular edges such that the irregular edges project away from both sides of the attachment seam.

13. The invention as recited in claim 11, wherein a plurality of elongate leaf-simulating strips extends in a pattern across a back covering portion of the jacket, and wherein at least a portion of the strips extending across the back covering portion are double edged strips comprising a pair of opposing irregular edges and a plurality of texture imparting surface pleats extending in transverse angled relation to the length dimension of the strips and wherein the double edged strips are attached to the garment by an attachment seam extending along the length dimension of the strips between the irregular edges such that the irregular edges project away from both sides of the attachment seam.

14. The invention as recited in claim 11, wherein elongate leaf-simulating strips comprising a plurality of texture imparting surface pleats extending in transverse angled relation to the length dimension of the strips are disposed along shoulder portions of the jacket such that an irregular edge projects away from the shoulder line of the jacket to disrupt the profile of the shoulder line.

15. The invention as recited in claim 14, wherein the strips are held within shoulder seams adapted to run substantially along the shoulder line.

16. The invention as recited in claim 11, wherein elongate leaf-simulating strips comprising a plurality of texture imparting surface pleats extending in transverse angled relation to the length dimension of the strips are disposed along exterior sleeve portions of the jacket such that an irregular edge projects away from the exterior sleeve portions to disrupt the profile of the sleeves.

17. The invention as recited in claim 16, wherein the strips are held within garment assembly seams extending along exterior sleeve portions of the jacket.

18. A camouflage outer wear system comprising a pair of trousers, for covering a lower extremity portion of a user's body, wherein at least a portion of the trousers comprises a single layer base fabric of camouflage printed textile material with a plurality of elongate leaf-simulating strips of camouflage printed material having a length dimension and a width dimension attached to the front of the trousers in partial covering relation to the base fabric so as to impart an irregular surface across the front of the trousers, and wherein at least a portion of the strips of camouflage printed material comprise a plurality of texture imparting surface pleats extending in transverse angled relation to the length dimension of the strips and wherein the base fabric of camouflage printed material and the strips of camouflage printed material consist essentially of knitted mesh fabric.

19. The invention as recited in claim 18, wherein a rear portion of the trousers is substantially free from said leaf-simulating strips.

20. The invention as recited in claim 18, wherein elongate leaf-simulating strips comprising a plurality of texture imparting surface pleats extending in transverse angled relation to the length dimension of the strips are disposed along the exterior of the user's legs such that an irregular edge projects away from the sides of the trousers to disrupt the profile of the trousers.

21. The invention as recited in claim 20, wherein the strips are held within trouser out seams adapted to run along the exterior of the user's legs.

22. A camouflage outer wear system comprising a hood for covering a head portion of a user's body, wherein at least a portion of the hood comprises a single layer base fabric of camouflage printed textile material with at least one elongate leaf-simulating strip of camouflage printed material having a length dimension and a width dimension disposed over the top of the hood so as to impart an irregular surface across the top and sides of the hood, and wherein said strip camouflage printed material comprises a plurality of texture imparting surface pleats extending in transverse angled relation to the length dimension of the strip and wherein the base fabric of camouflage printed material and the strips of camouflage printed material consist essenstially of knitted mesh fabric.

23. The invention as recited in claim 22, wherein the hood further comprises a face veil structure including a lower portion of camouflage printed fabric adapted to cover a lower portion of a user's face and an upper portion of see through mesh adapted to be folded over an upper portion of the user's face.

24. A camouflage outer wear system comprising: a jacket, for covering a chest and arm portion of a user's body, wherein at least a portion of the jacket comprises a single layer base fabric of camouflage printed textile material with a plurality of elongate leaf-simulating strips of camouflage printed material having a length dimension and a width dimension attached to the jacket in partial covering relation to the base fabric so as to impart an irregular surface across the jacket, and a pair of trousers, for covering a lower extremity portion of a user's body, wherein at least a portion of the trousers comprises a single layer base fabric of camouflage printed textile material with a plurality of elongate leaf-simulating strips of camouflage printed material having a length dimension and a width dimension attached to the front of the trousers in partial covering relation to the base fabric so as to impart an irregular surface across the front of the trousers, and wherein at least a portion of the strips of camouflage printed material comprise a plurality of texture imparting surface pleats extending in transverse angled relation to the length dimension of the strips and wherein in the jacket, the base fabric of camouflage printed material and the strips of camouflage printed material consist essentially of knitted mesh fabric and wherein in the trousers, the base fabric of camouflage printed material and the strips of camouflage printed material consist essentially of knitted mesh fabric.

25. The invention as recited in claim 24, further comprising a hood for covering a head portion of the user's body, wherein at least a portion of the hood comprises at least one elongate leaf-simulating strip of camouflage printed material having a length dimension and a width dimension disposed over the top of the hood so as to impart an irregular surface across the top and sides of the hood.

* * * * *